US007637328B2

(12) United States Patent
Sato

(10) Patent No.: US 7,637,328 B2
(45) Date of Patent: Dec. 29, 2009

(54) ELECTRICAL POWER TOOL HAVING VIBRATION CONTROL MECHANISM

(75) Inventor: Shinichiro Sato, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/779,384

(22) Filed: Jul. 18, 2007

(65) Prior Publication Data

US 2008/0017395 A1 Jan. 24, 2008

(30) Foreign Application Priority Data

Jul. 20, 2006 (JP) ..... P2006-198664

(51) Int. Cl.
*B25D 11/00* (2006.01)

(52) U.S. Cl. ..... 173/162.2; 173/162.1; 173/48; 173/109; 173/201; 173/210; 173/211; 173/49; 173/104; 16/431; 16/116 R

(58) Field of Classification Search ..... 173/162.1, 173/162.2, 171, 48, 109, 201, 210, 211, 49, 173/104; 416/431, 116 R; 16/431, 116 R
See application file for complete search history.

(56) References Cited

U.S. PATENT DOCUMENTS

| | | | | |
|---|---|---|---|---|
| 3,652,074 | A * | 3/1972 | Frederickson et al. | 267/137 |
| 4,138,812 | A * | 2/1979 | Zimmerer et al. | 30/381 |
| 4,282,938 | A | 8/1981 | Minamidate | |
| 5,839,517 | A * | 11/1998 | Gwinn et al. | 173/162.2 |
| 5,927,407 | A * | 7/1999 | Gwinn et al. | 173/162.2 |
| 6,948,570 | B2 * | 9/2005 | Kristen et al. | 173/162.1 |
| 6,962,211 | B2 * | 11/2005 | Daubner et al. | 173/162.2 |
| 7,100,706 | B2 * | 9/2006 | Meixner et al. | 173/162.2 |

FOREIGN PATENT DOCUMENTS

| | | |
|---|---|---|
| EP | 1 252 976 | 10/2002 |
| EP | 1464449 | 10/2004 |
| GB | 208 092 | 12/1923 |
| GB | 2 086 005 | 5/1982 |
| JP | 2004-299036 | 10/2004 |

* cited by examiner

*Primary Examiner*—Rinaldi I. Rada
*Assistant Examiner*—Michelle Lopez
(74) *Attorney, Agent, or Firm*—Antonelli, Terry, Stout & Kraus, LLP.

(57) ABSTRACT

An electrical power tool includes a housing, an electrical motor, a motion conversion mechanism, a weight-supporting member, a counterweight, and a first supporting member and a second supporting member. The first supporting member and the second supporting member are each provided on the housing for supporting the weight-supporting member to the housing. The weight-supporting member has a first connecting part and a second connecting part supported by the first supporting member and the second supporting member, respectively; and an elastically deforming part. The elastically deforming part is positioned between the first connecting part and the second connecting part and has a mounting part for mounting the counterweight. The elastically deforming part includes a portion having a smaller cross-sectional area than each cross-sectional area of the first connecting part and the second connecting part.

17 Claims, 6 Drawing Sheets

ELECTRICAL POWER TOOL HAVING VIBRATION CONTROL MECHANISM

BACKGROUND OF THE INVENTION

1. Field of the Invention

The present invention relates to an electrical power tool and more specifically, to an electrical power tool having a vibration control mechanism.

2. Description of the Related Art

Conventionally, electrical power tools having vibration control mechanisms have been proposed. For example, Japanese Patent Application Publication No. 2004-299036 discloses an electrical power tool including a casing that has a handle, a motor housing, and a gear housing connected with one another. An electrical motor is accommodated in the motor housing. The gear housing has a motion conversion housing, a vibration control housing, and an impact housing. A motion conversion mechanism that converts a rotation motion of the electrical motor into a reciprocation motion is provided in the motion conversion housing. A cylinder extending a direction perpendicular to the rotation axis of the electrical motor is provided in the impact housing. A tool support portion is provided on the front side of the cylinder and is capable of attaching or detaching a working tool.

A piston is provided in the cylinder and is slidably provided along the inner periphery of the cylinder. The piston reciprocates along the inner periphery of the cylinder by the motion conversion mechanism. A striking member is provided in the front section of the cylinder and is slidably provided along the inner periphery of the cylinder. An air chamber is formed in the cylinder between the piston and the striking member. An intermediate member is provided in the front side of the striking member and is slidably provided back-and-forth within the cylinder. The working tool mentioned above is positioned at the front side of the intermediate member.

The vibration control housing is provided on the side of the impact housing and communicates with the impact housing by way of an air channel. A space formed by the piston, the cylinder, the impact housing, the counterweight, and the vibration control housing is formed as a sealed space. A counterweight and two springs are provided in the vibration control housing. The counterweight is capable of moving a reciprocation motion parallel to the reciprocation motion of the piston. The two springs are positioned at the ends of the counterweight.

The rotational driving force of the electrical motor is transmitted to the motion conversion mechanism, and the motion conversion mechanism moves the piston in the cylinder in the reciprocation motion. The reciprocation motion of the piston repeatedly increases and decreases the pressure of the air in the air chamber, thereby applying an impact force to the striking member. The striking member moves forward and collides with the rear end of the intermediate member, thereby applying the impact force to the working tool. The workpiece is fractured by the impact force applied to the working tool.

During the operation of the electrical power tool, when the piston moves forward, the counterweight moves rearward because the space formed by the piston, the cylinder, the impact housing, the counterweight, and the vibration control housing is a sealed space. Conversely, when the piston moves rearward, the counterweight moves forward. Thus, in this structure, the counterweight reciprocates in conjunction with the reciprocation motion of the piston.

SUMMARY OF THE INVENTION

However, the electrical power tool described above requires the cylinder with high production cost and a large number of parts, thereby leading high cost. Further, two vibration control housings need to provide on the both sides of the impact housing for canceling the rotational moments acting on the electrical power tool, thereby increasing the number of parts.

Further, the vibration control housings are provided on the both sides of the impact housing, thereby leading to an increased size in the electrical power tool, reduced visibility and reduced operability of the electrical power tool.

In view of the foregoing, it is an object of the present invention to provide an electrical power tool that is capable of efficiently reducing the vibration resulting from the striking member and that does not lead to an increased size and to reduced operability of the electrical power tool.

In order to attain the above and other objects, the present invention provides an electrical power tool including a housing, an electrical motor, a motion conversion mechanism, a weight-supporting member, a counterweight, and a first supporting member and a second supporting member. The electrical motor is accommodated in the housing. The motion conversion mechanism is configured to convert a rotary motion of the electrical motor into a reciprocation motion. The weight-supporting member extends in a direction perpendicular to directions of the reciprocation motion and is capable of being elastically deformed in the directions of the reciprocation motion. The counterweight is supported on the weight-supporting member. The first supporting member and the second supporting member each provided on the housing for supporting the weight-supporting member to the housing. The weight-supporting member has a first connecting part and a second connecting part supported by the first supporting member and the second supporting member, respectively; and an elastically deforming part. The elastically deforming part is positioned between the first connecting part and the second connecting part and has a mounting part for mounting the counterweight. The elastically deforming part includes a portion having a smaller cross-sectional area than each cross-sectional area of the first connecting part and the second connecting part.

DETAILED DESCRIPTION OF THE PREFERRED EMBODIMENTS

Figure 1:
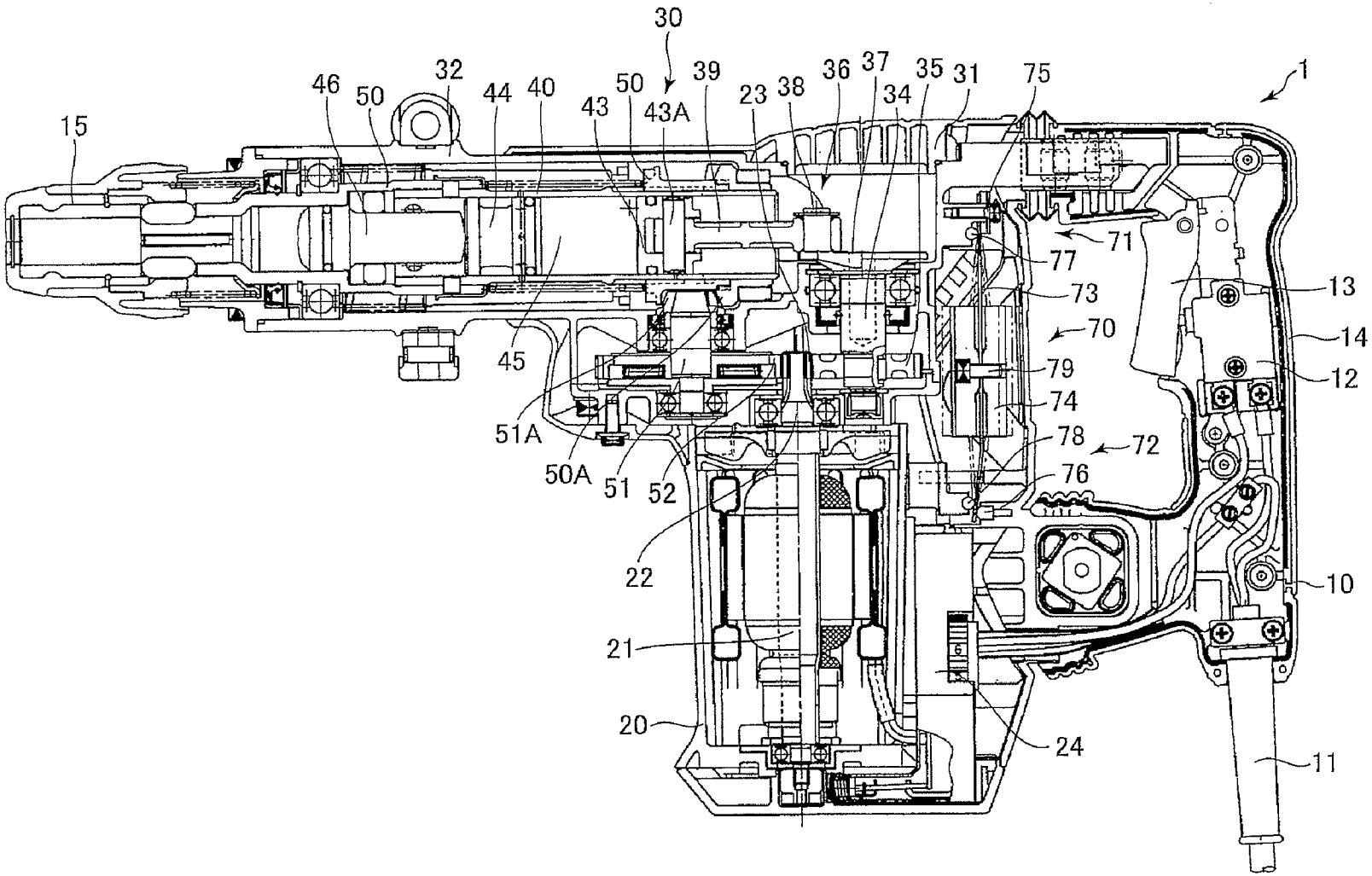
FIG. 1 is a cross-sectional view showing an impact tool according to a first embodiment of the present invention.

An electrical power tool according to a first embodiment of the present invention will be described while referring to FIGS. 1 through 5. The electrical power tool of the first embodiment is applied to an impact tool 1. In FIG. 1, the left side will be described as the front side of the impact tool 1 and the right side will be described as the back side of the impact tool 1. The impact tool 1 includes a casing having a handle 10, a motor housing 20, and a gear housing 30 connected with one another.

A power cable 11 is attached to the handle 10. The handle 10 houses a switch mechanism 12. A trigger 13 that can be manipulated by the user is mechanically connected to the switch mechanism 12. The switch mechanism 12 is connected to an external power source (not shown) through the power cable 11. By operating the trigger 13, an electrical motor 21 described later can be connected to and disconnected from the external power source. Also, the handle 10 includes a grip 14 that is gripped by the user when the impact tool 1 is used.

The motor housing 20 is positioned at a lower front side of the handle 10. The electrical motor 21 is accommodated in the motor housing 20. The electrical motor 21 includes an output shaft 22 that outputs a driving force of the electrical motor 21. A pinion gear 23 is provided on the end of the output shaft 22 and is positioned in the gear housing 30. A control unit 24 for controlling a rotation speed of the electrical motor 21 is located on the motor housing 20 behind the electrical motor 21.

The gear housing 30 includes a motion conversion housing 31 and a hammer housing 32. The motion conversion housing 31 is positioned above the motor housing 20 and a rear end of the motion conversion housing 31 is connected to the handle 10. The hammer housing 32 is positioned above the motor housing 20.

A crank shaft 34 that extends parallel to the output shaft 22 is rotatably supported on the rear side of the pinion gear 23 in the motion conversion housing 31. A first gear 35 that is meshingly engaged with the pinion gear 23 is coaxially fixed to the lower end of the crank shaft 34. A motion conversion mechanism 36 is provided at the upper side of the crank shaft 34. The motion conversion mechanism 36 includes a crank weight 37, a crank pin 38, and a connecting rod 39. The crank weight 37 is fixed to the upper end of the crank shaft 34. The crank pin 38 is fixed to the end portion of the crank weight 37. The crank pin 38 is inserted into the rear end of the connecting rod 39.

A rotation transmission shaft 51 extending parallel to the output shaft 22 is rotatably supported on the front side of the pinion gear 23 in the motion conversion housing 31. A second gear 52 that is meshingly engaged with the pinion gear 23 is coaxially fixed to the lower end of a rotation transmission shaft 51. A first bevel gear 51A is coaxially fixed to the upper end of the rotation transmission shaft 51.

A cylinder 40 extending in a direction perpendicular to the output shaft 22 is provided in the hammer housing 32. The center axis of the cylinder 40 and the rotation axis of the output shaft 22 are positioned on a same plane. The rear end of the cylinder 40 opposes the electrical motor 21 in the axial direction of the output shaft 22. A piston 43 is provided in the cylinder 40 and is slidably provided along the inner periphery of the cylinder 40. The piston 43 reciprocates in the axial direction of the cylinder 40. The piston 43 includes a piston pin 43A that is inserted into the front end of the connecting rod 39. A striking member 44 is provided in the front section of the cylinder 40 and is slidably provided along the inner periphery of the cylinder 40 in the axial direction thereof. An air chamber 45 is formed among the cylinder 40, the piston 43, and the hammer 44.

A rotating cylinder 50 is rotatably supported in the hammer housing 32. The rotating cylinder 50 surrounds the front section of the outer perimeter of the cylinder 40. The rotating cylinder 50 extends forward of the cylinder 40, and a tool support portion 15 is provided at the end of the rotating cylinder 50 and is capable of attaching or detaching a working tool (not shown). A second bevel gear 50A that is meshingly engaged with the first bevel gear 51A is provided on the rear end portion of the rotating cylinder 50. The center axis of the rotating cylinder 50 and the rotation axis of the output shaft 22 are positioned on a same plane. Also, an intermediate member 46 is provided in the front side of the striking member 44 and is slidably provided against the rotating cylinder 50. The intermediate member 46 reciprocates in the axial direction of the rotating cylinder 50.

A counterweight mechanism 70 is provided in the motion conversion housing 31 and in opposition to the handle 10. The counterweight mechanism 70 will be described while referring to FIGS. 1 through 5. The counterweight mechanism 70 includes first and second supporting members 71 and 72, a weight-supporting member 73, and a counterweight 74. The first and second supporting members 71 and 72 are positioned on a plane perpendicular to the reciprocating direction of the piston 43. The first supporting member 71 opposes the second supporting member 72 on the plane. The first supporting member 71 includes a first outside supporting member 75 and a first inside supporting member 77 positioned closer to the counterweight 74 than the first outside supporting member 75 to the counterweight 74. The second supporting member 72 includes a second outside supporting member 76 and a second inside supporting member 78 positioned closer to the counterweight 74 than the second outside supporting member 75 to the counterweight 74.

Figure 2:
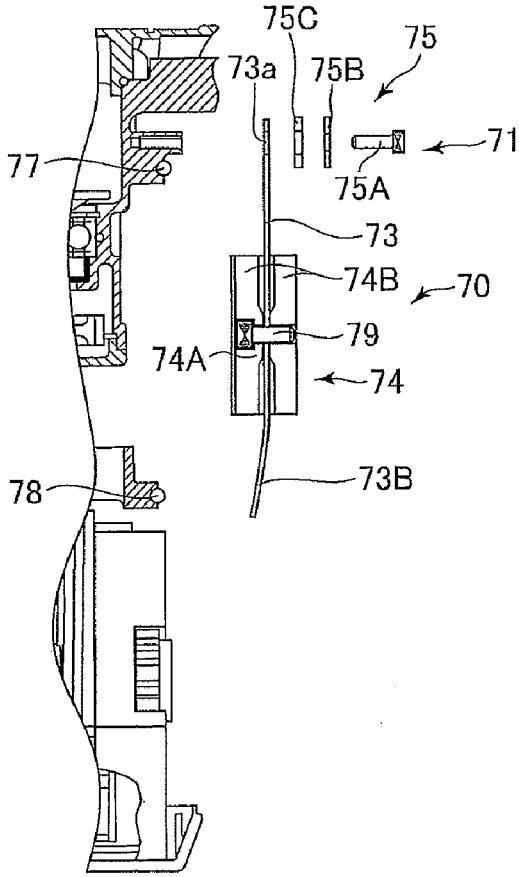
FIG. 2 is an exploded view of a counterweight mechanism of the impact tool according to the first embodiment of the present invention.
Figure 3:
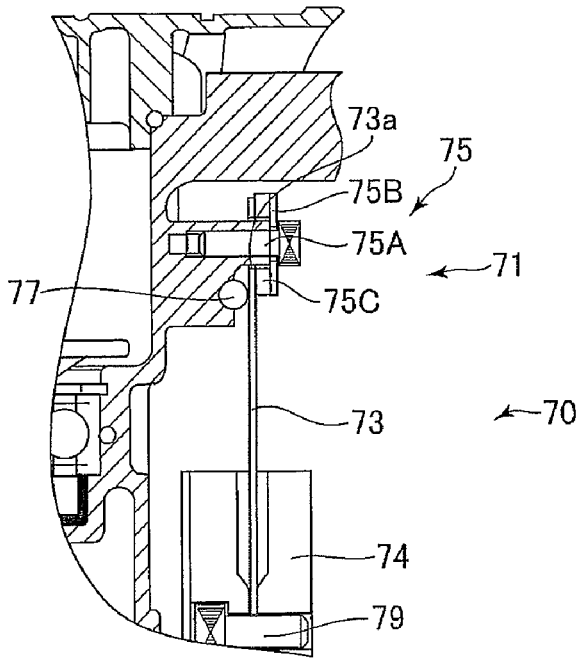
FIG. 3 is an enlarged view of the counterweight mechanism of the impact tool according to the first embodiment of the present invention.

As shown in FIGS. 2 and 3, the first outside supporting member 75 includes a bolt 75A, a washer 75B, and a spacer 75C. The weight-supporting member 73 is formed with a first bolt insertion hole 73*a*. The bolt 75A is inserted through the washer 75B, the spacer 75C, and the first bolt insertion hole 73*a*. Hence, the upper end portion of the weight-supporting member 73 is fixed to the motion conversion housing 31. The upper end portion of the weight-supporting member 73 is blocked by the first outside supporting member 75 from moving in one direction (toward the rear side) of the directions (back-and-forth directions) for the reciprocation motion of the piston 43.

The first inside supporting member 77 is positioned below the first outside supporting member 75 and on the front side of the weight-supporting member 73. The upper end portion of the weight-supporting member 73 is blocked by the first inside supporting member 77 from moving in another direction (toward the front side), opposite to the one direction, of the directions (back-and-forth directions) for the reciprocation motion of the piston 43. The second outside supporting member 76 is made from rubber and positioned on the lower end portion and on the rear side of the weight-supporting member 73. The second outside supporting member 76 blocks the lower end portion of the weight-supporting member 73 from moving toward the rear side. The second inside supporting member 78 is positioned above the second outside supporting member 76 and on the front side of the weight-supporting member 73. The second inside supporting member 78 blocks the lower end portion of the weight-supporting member 73 from moving toward the front side. The first and second outside supporting members 75 and 76 and the first and second inside supporting members 77 and 78 are positioned so that a rearward offset load F is applied to the weight-supporting member 73.

Next, the weight-supporting member 73 will be described with reference to FIGS. 4 and 5. FIG. 5 is a front view of the weight-supporting member 73. The weight-supporting member 73 is configured of a leaf spring and extends in a direction orthogonal to the direction in which the piston 43 reciprocates. The weight-supporting member 73 includes a first connecting part 73B and a second connecting part 73C positioned one on either end of the weight-supporting member 73, and an elastically deforming part 73D coupled to the first and second connecting parts 73B and 73C. The first bolt insertion hole 73*a* is formed on the weight-supporting member 73. The first bolt insertion hole 73*a* (surrounding the first bolt insertion hole 73*a*) of the weight-supporting member 73 serves as a drop prevention portion that prevents the weight-supporting member 73 from dropping out from the first outside supporting member 75. The first connecting part 73B is supported on the motion converting housing 31 by the first supporting member 71. The spacer 75C and the first inside supporting member 77 contact the first connecting part 73B. The second connecting part 73C is supported on the motion converting housing 31 by the second supporting member 72. Since the second outside supporting member 76 is made from rubber, the upper end portion of the weight-supporting member 73 is supported by the second outside supporting member 76 while being capable of moving up and down with respect to the second outside supporting member 76.

The elastically deforming part 73D includes first and second deforming parts 73D1 and 73D2, and a weight-mounting part 73D3. A second bolt insertion hole 73*e* is formed in the weight-mounting part 73D3. The weight-mounting part 73D3 is positioned substantially in the center of the elastically deforming part 73D; the first deforming part 73D1 is positioned between the first connecting part 73B and the weight-mounting part 73D3; and the second deforming part 73D2 is positioned between the second connecting part 73C and the weight-mounting part 73D3. As shown in FIG. 4, the second deforming part 73D2 is bent from the approximate center region thereof to the front side.

Notches 73*f* and 73*g* are formed in the first and second deforming parts 73D1 and 73D2, respectively. As shown in FIG. 5, the first and second deforming parts 73D1 and 73D2 have gradually changing widths due to the notches 73*f* and 73*g*. Specifically, the first and second deforming parts 73D1 and 73D2 narrow toward the center regions thereof. Accordingly, each cross-sectional area of the first and second deforming parts 73D1 and 73D2 is smaller than the cross-sectional area in a portion where the first connecting part 73B contacts the first inside supporting part 77, the cross-sectional area in a portion where the second connecting part 73C contacts the second inside supporting part 78, and the cross-sectional area in a portion of the weight-mounting part 73D3 where the second bolt insertion hole 73*e* is not formed.

The counterweight 74 is configured of two components and is fixed to the weight-mounting part 73D3 by inserting a bolt 79 through the second bolt insertion hole 73*e*. Hence, the counterweight 74 is doubly supported at its both ends by the weight-supporting member 73. The counterweight 74 has a center of gravity positioned at a center of the weight-mounting part 73D3.

Figure 4:
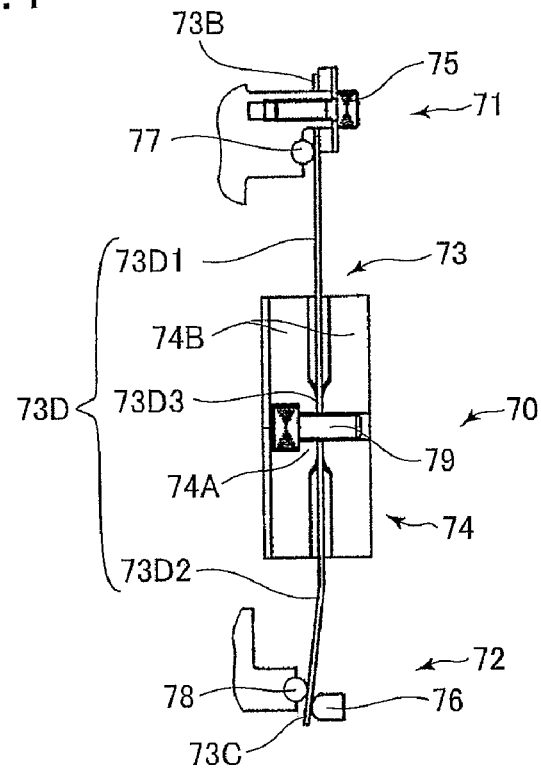
FIG. 4 is a side view of the counterweight mechanism of the impact tool according to the first embodiment of the present invention.
Figure 5:
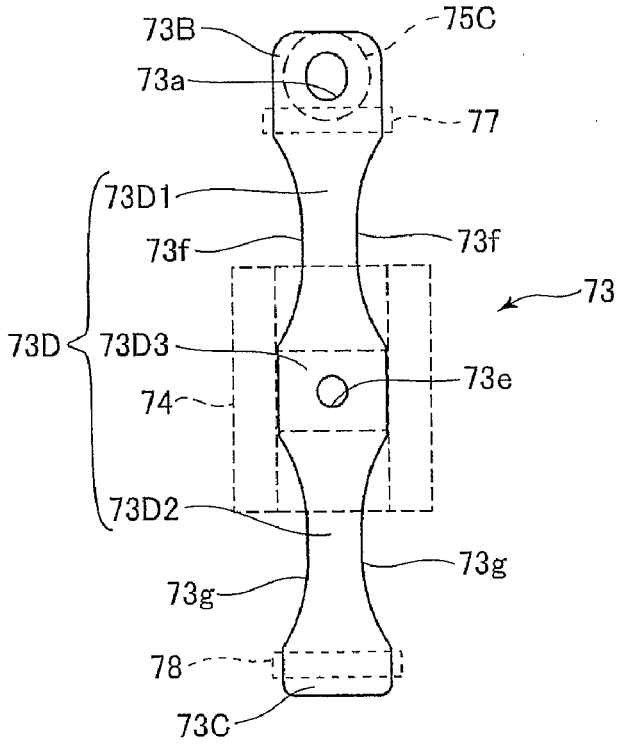
FIG. 5 is a front view of the weight-supporting member of the impact tool according to the first embodiment of the present invention.

As shown in FIG. 4, the counterweight 74 includes a base 74A and two legs 74B and has an H-shaped. The base 74A extends in a direction perpendicular to the extending direction of the weight-supporting member 73 and is fixed to the weight-supporting member 73. Each of the two legs 74B is connected to the ends of the base 74A and extends along and is separated from the weight-supporting member 73. Hence, the counterweight 74 is H-shaped. The distances from the first outside supporting member 75 (the lower end of the spacer 75C) and the second outside supporting member 76 to positions where the counterweight 74 is fixed to the weight-mounting part 73D3 are identical. The distances from the first and second inside supporting members 77 and 78 to positions where the counterweight 74 is fixed to the weight-mounting part 73D3 are identical.

Next, the operation of the impact tool 1 according to the first embodiment will be described. The working tool (not shown) is pressed against a workpiece (not shown) with the handle 10 gripped by the user. Next, the trigger 12 is pulled to supply power to and rotate the electrical motor 21. This rotation driving force is transmitted to the crank shaft 34 by way of the pinion gear 23 and the first gear 35. The rotation of the crank shaft 34 is converted into reciprocation motion of the piston 43 in the cylinder 40 by the motion converter mechanism 36 (the crank weight 37, the crank pin 38, and the connecting rod 39). The reciprocation motion of the piston 43 leads to repeated increments and decrements of the pressure of the air in the air chamber 45, thereby causing a reciprocation motion of the striking member 44. The striking member 44 moves forward and collides with the rear end of the intermediate member 46, thereby applying an impact force to the working tool (not shown).

Also, the rotation driving force of the electrical motor 21 is transmitted to the pinion gear 23, the second gear 52, and the rotation transmission shaft 51. The rotation of the rotation transmission shaft 51 is transmitted to the rotating cylinder 50 by way of the first bevel gear 51A and the second bevel gear 50A, resulting in rotation of the rotating cylinder 50. The rotation of the rotating cylinder 50 applies a rotation force to the working tool (not shown). The workpiece (not shown) is fractured by the rotation force and the impact force described above applied to the working tool (not shown).

During the operation of the impact tool 1 described above, a vibration with a roughly constant frequency resulting from the reciprocation motion of the striking member 44 is generated in the impact tool 1. The vibration is transmitted to the first and second supporting members 71 and 72 by way of the motion conversion housing 31. The vibration transmitted to the first and second supporting members 71 and 72 is transmitted to the weight-supporting member 73 and the counterweight 74, leading to an elastic deformation of the weight-mounting part 73D3 and the vibration of the counterweight 74 in a direction that the piston 43 reciprocates. The vibration of the impact tool 1 can be reduced by the vibration of the counterweight 74, thereby improving the operation of the impact tool 1.

When the counterweight 74 moves forward from an its initial position and returns to the initial position due to the vibration of the striking member 44, the weight-supporting member 73 is supported by the first and second outside supporting members 75 and 76 and the first and second inside supporting members 77 and 78. While the counterweight 74 is displaced rearward from the initial position until the load applied to the weight-supporting member 73 is identical to the offset load F applied by the first and second outside supporting members 75 and 76, the weight-supporting member 73 is supported by the first and second outside supporting members 75 and 76 and the first and second inside supporting members 77 and 78. When a load greater than the offset load F is applied to the weight-supporting member 73, the weight-supporting member 73 is supported by the first and second outside supporting members 75 (the spacer 75C) and 76. As stated above, the vibration of the impact tool 1 due to impact can be reduced by the vibration of the weight-supporting member 73 and the counterweight 74, thereby improving the operation of the impact tool 1.

More specifically, the vibration of a frequency band having a constant width centering on a resonance frequency is reduced by the vibration of the counterweight 74. The resonance frequency is determined by the counterweight 74 and the elastically deforming part 73D which is a leaf spring. The resonance frequency is set up to be roughly identical to the frequency of the vibration generated by the impact of the impact tool 1. A resonance frequency (resonance point) f is represented by:

$$f=1/(2\pi)((k_1+k_2)/m)^{1/2} \quad (1)$$

where the spring constants of the weight-supporting member 73 made from the leaf spring are $k_1$ (the spring constant of the first deforming part 73D1), $k_2$ (the spring constant of the second deforming part 73D2), and the mass of the counterweight 74 is m. Practically, the actual resonance frequency band will be slightly wider and slightly lower than the theoretical resonance frequency band due to the influence of damping and the like. Thus, the resonance point determined from the above equation is set to be slightly higher than the vibration frequency of the impact tool 1.

Therefore, it is necessary to reduce the spring constant of the elastically deforming part 73D (making the elastically deforming part 73D more flexible) to obtain a desired resonance frequency in the counterweight mechanism 70 of the preferred embodiment. The spring constant k of a leaf spring having a simple shape is represented by:

$$k=(E\cdot b\cdot h^3)/(2\cdot l^3) \quad (2)$$

where E is the elastic coefficient of the leaf spring, b is the width, h is the thickness, and l is the length of the leaf spring. As can be seen from Equation (2), the spring constant k is proportional to the width b and the cube of the thickness h, and inversely proportional to the cube of the length l. Hence, the spring constant k can be decreased by narrowing the width b, reducing the thickness h, and increasing the length l.

However, simply reducing the width b and thickness h of the entire weight-supporting member 73 reduces the width and thickness of the first and second connecting parts 73B and 73C and the weight-mounting part 73D3 (reduces the cross-sectional area), thereby reducing the strength of these parts. Consequently, the weight-supporting member 73 may break when the elastically deforming part 73D is elastically deformed since the first and second connecting parts 73B and 73C and the weight-mounting part 73D3 cannot withstand the stress at this time. Further, if the length l of the weight-supporting member 73 is increased, the weight-supporting member 73 cannot be accommodated in the motion converting housing 31.

However, in the weight-supporting member 73 according to the preferred embodiment, each cross-sectional area of the first and second connecting parts 73B and 73C and the weight-mounting part 73D3 is not modified, but the first and second deforming parts 73D1 and 73D2 are formed narrower toward the center regions thereof. This structure can ensure the strength of the weight-supporting member 73 while preventing an increase in the length thereof and can yield a desired spring constant. Further, the widths of the first and second deforming parts 73D1 and 73D2 are changed gradually according to the notches 73*f* and 73*g*, thereby preventing a concentration of stress during reciprocating motion of the counterweight 74. Further, the weight-supporting member 73 having this configuration is easy to manufacture.

Since the counterweight mechanism 70 has a simple structure, a large number of parts such as expensive cylinders are not needed. The vibration of the impact tool 1 can be reduced without leading to a increased size, higher expenses, reduced visibility, and the like in the impact tool 1.

Figure 6:
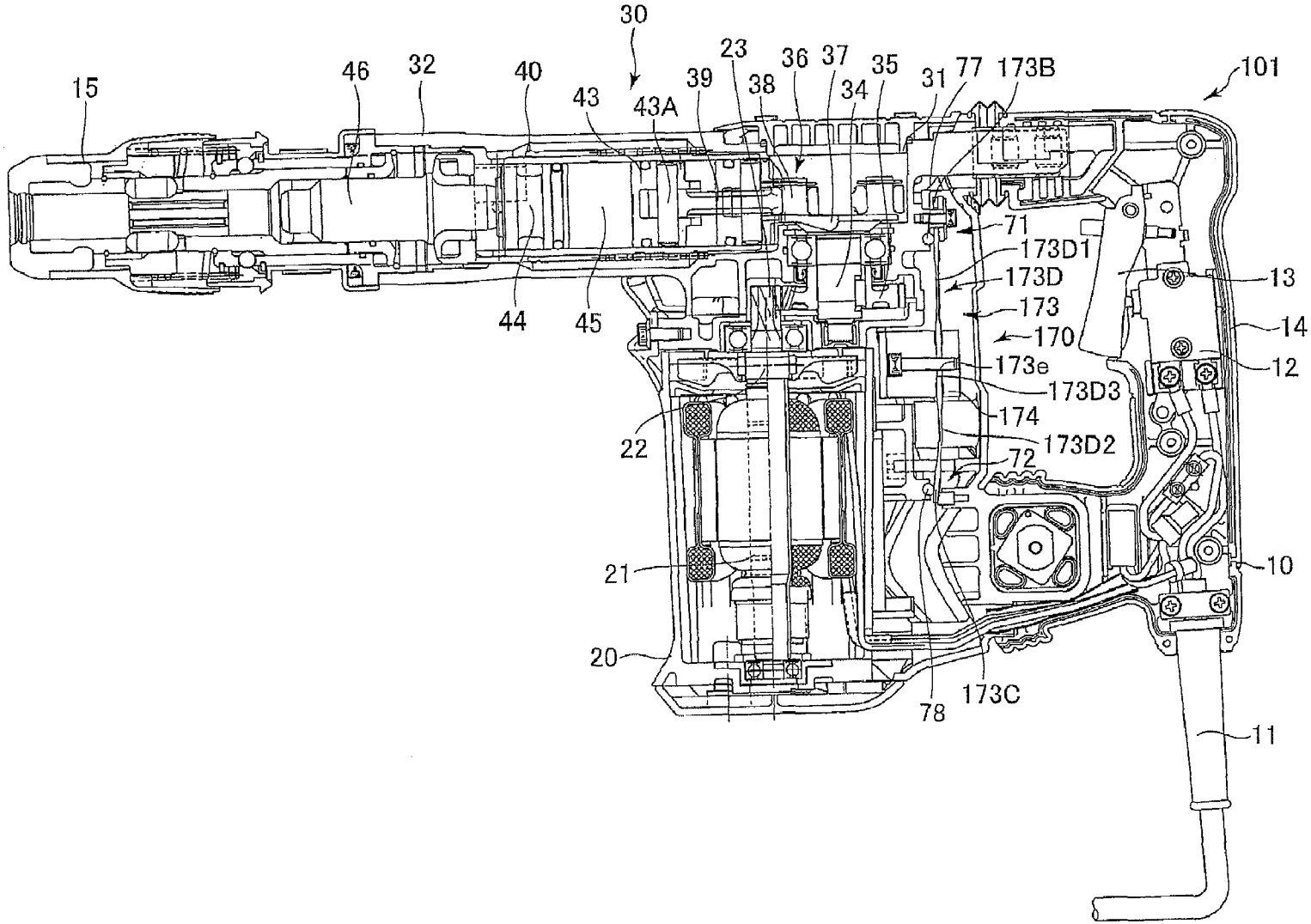
FIG. 6 is a cross-sectional view showing an impact tool according to a second embodiment of the present invention.

Next, an electrical power tool according to a second embodiment of the present invention will be described while referring to FIG. 6. The electrical power tool of the present invention is applied to an impact tool 101. Like parts and components that are the same as those of the first embodiment will be assigned the same reference numerals to avoid duplicating descriptions, and only different aspects will be described. The impact tool 101 according to the second embodiment does not include the rotating cylinder 50 and the control unit 24 used in the impact tool 1 of the first embodiment. Therefore, no rotation is applied to the working tool during the operation of the impact tool 101, and the electrical motor 21 rotates at a fixed speed.

A counterweight mechanism 170 according to the second embodiment has a weight-supporting member 173. The weight-supporting member 173 includes a first connecting part 173B and a second connecting part 173C positioned one on each end of the weight-supporting member 173, and an elastically deforming part 173D connecting the first and second connecting parts 173B and 173C. The elastically deforming part 173D includes first and second deforming parts 173D1 and 173D2 and a weight-mounting part 173D3. The first and second deforming parts 173D1 and 173D2 have a thickness formed partially thinner than the first and second connecting parts 173B and 173C and the weight-mounting part 173D3. Accordingly, each cross-sectional area of the first and second deforming parts 173D1 and 173D2 is smaller than the cross-sectional area in a portion where the first connecting part 173B contacts the first inside supporting member 77, the cross-sectional area in a portion where the second connecting part 173C contacts the second inside supporting member 78, and the cross-sectional area in a portion of the weight-mounting part 173D3 in which a second bolt insertion hole 173*e* is not formed. Further, a counterweight 174 is shaped to extend in a direction in which the piston 43 reciprocates.

Since the first and second deforming parts 173D1 and 173D2 have a narrow thickness in the counterweight mechanism 170 according to the second embodiment, the spring constant of the weight-supporting member 173 can be reduced, as is clear from Equation (2). Therefore, as in the first embodiment described above, it is possible to ensure the strength of the weight-supporting member 173 according to the second embodiment, while preventing an increase in the length thereof, and to obtain a desired spring constant. The impact tool 101 according to the second embodiment also obtains the same effects as the impact tool 1 according to the first embodiment described above.

Figure 7:
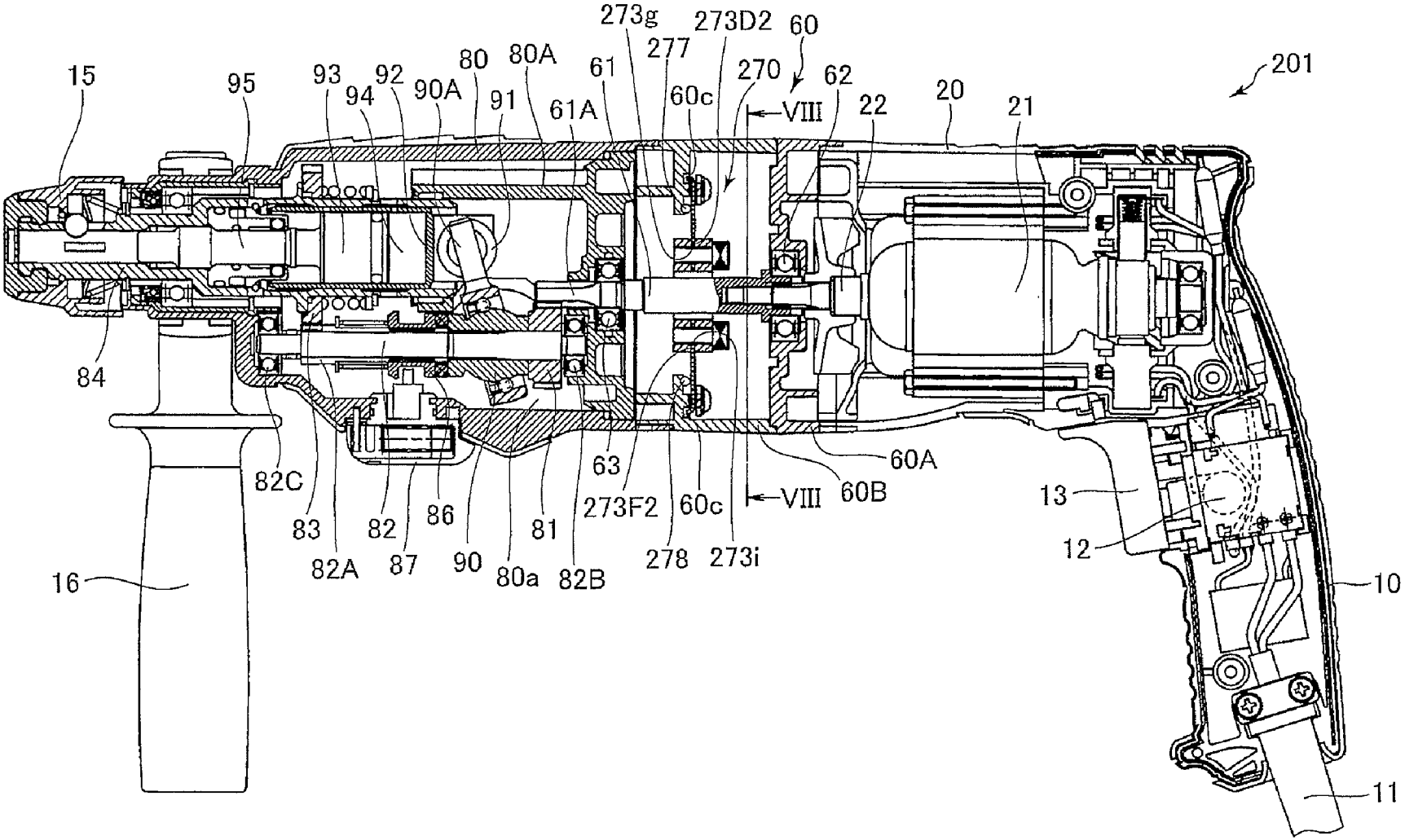
FIG. 7 is a cross-sectional view showing an impact tool according to a third embodiment of the present invention.

Next, an electrical power tool according to a third embodiment of the present invention will be described while referring to FIGS. 7 and 8. The electrical power tool of the present invention is applied to an impact tool 201. The impact tool 201 includes a casing having the handle 10, the motor housing 20, a weight housing 60, and a gear housing 80.

The power cable 11 is attached to the handle 10. The handle 10 houses the switch mechanism 12. The trigger 13 that can be manipulated by the user is mechanically connected to the switch mechanism 12. The switch mechanism 12 is connected to an external power source (not shown) through power cable 11. By operating the trigger 13, the switch mechanism 12 can be connected to and disconnected from the external power source.

The motor housing 20 is provided on the front side of the handle 10. The handle 10 and the motor housing 20 are formed integrally from plastic. The electrical motor 21 is accommodated in the motor housing 20. The electrical motor 21 includes the output shaft 22 and outputs rotational drive force.

The weight housing 60 is located on the front side of the motor housing 20 and is made from resin. The weight housing 60 includes a first weight housing 60A opposing the motor housing 20 and a second weight housing 60B opposing the gear housing 80. A first intermediate shaft 61 is provided in the weight housing 60 and extends in a direction that the output shaft 22 extends. The first intermediate shaft 61 is rotatably supported by bearings 62 and 63. The rear end portion of the first intermediate shaft 61 is connected to the output shaft 22. The front end portion of the first intermediate shaft 61 is positioned in the gear housing 80 and is provided with a fourth gear 61A.

A counterweight mechanism 270 is provided in the weight housing 60. As shown in FIG. 10, which is a cross-sectional view taken along the VIII-VIII line in FIG. 7, the counterweight mechanism 270 includes first and second supporting members 271 and 272, a weight-supporting member 273, a counterweight 274, and bolts 279. The first and second supporting members 271 and 272 are positioned on a plane perpendicular to the reciprocating direction of a piston 92 described later. The first supporting member 271 opposes the second supporting member 272 on the plane. The first supporting member 271 includes a first outside supporting member 275 and a first inside supporting member 277 positioned closer to the counterweight 274 than the first inside supporting member 275 to the counterweight 274. The second supporting member 272 also includes a second outside supporting member 276 and a second inside supporting member 278 positioned closer to the counterweight 274 than the second inside supporting member 276 to the counterweight 274. The first outside supporting member 275 blocks the upper end portion of a first weight-supporting member 273A described later from moving toward the rear side. The first inside supporting member 277 is positioned below the first outside supporting member 275 and on the front side of the first weight-supporting member 273A and prevents the first weight-supporting member 273A from moving toward the front side.

The second outside supporting member 276 is positioned at the lower end of a second weight-supporting member 273B described later and blocks the second weight-supporting member 273B from moving toward the rear side. The second inside supporting member 278 is positioned above the first outside supporting member 276 and on the front side of the second weight-supporting member 273B and blocks the second weight-supporting member 273B from moving toward the front side. The first and second outside supporting members 275 and 276 and the first and second inside supporting members 277 and 278 are positioned so that a rearward offset load F is applied to the weight-supporting member 273.

The weight-supporting member 273 includes the first weight-supporting member 273A and the second weight-supporting member 273B. The first and second weight-supporting members 273A and 273B are configured of leaf springs and extend in a direction orthogonal to the direction in which the piston 92 reciprocates. As shown in FIG. 7, the upper end portion of the first weight-supporting member 273A and the lower end portion of the second weight-supporting member 273B are roughly L-shaped, and each of the distal ends of the upper and lower end portions is positioned in each of recesses 60*c* formed in the second weight housing 60B.

Figure 8:
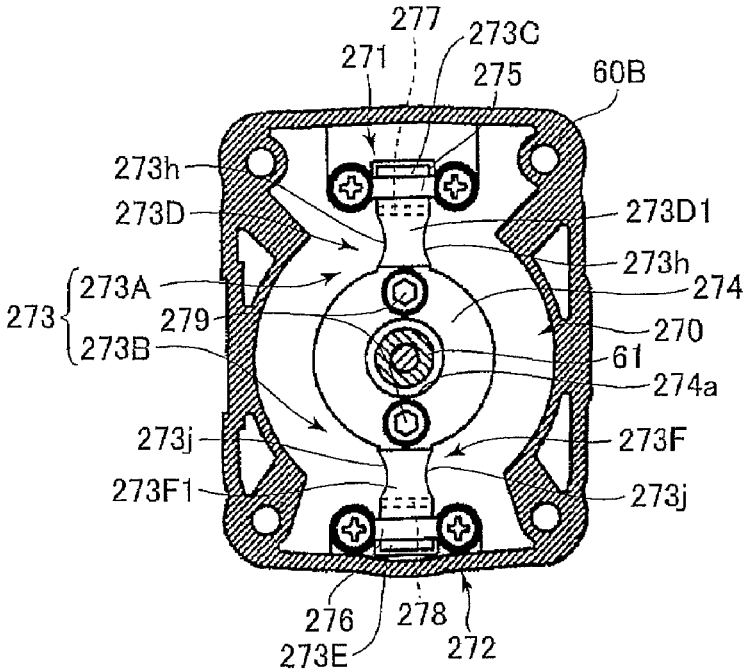
FIG. 8 is a cross-sectional view of the impact tool taken along a line VIII-VIII in FIG. 7.

As shown in FIG. 8, the first weight-supporting member 273A includes a first connecting part 273C and an elastically deforming part 273D. The first connecting part 273C is supported on the second weight housing 60B via the first outside supporting member 275. The elastically deforming part 273D includes a first deforming part 273D1 and a weight-mounting part 273D2 (see FIG. 7). A second bolt insertion hole 273*g* is formed in the weight-mounting part 273D2. The first deforming part 273D1 is positioned between the first connecting part 273C and the weight-mounting part 273D2. Notches 273*h* are formed in the first deforming part 273D1. The notches 273*h* gradually change the width of the first deforming part 273D1. Specifically, the first deforming part 273D1 narrows toward the center region thereof. Therefore, the cross-sectional area of the first deforming part 273D1 is smaller than the cross-sectional area in a portion where the first connecting part 273C contacts the first inside supporting member 277 and the cross-sectional area in a portion of the weight-mounting part 273D2 in which the second bolt insertion hole 273*g* is not formed.

The second weight-supporting member 273B includes a second connecting part 273E and an elastically deforming part 273F. The second connecting part 273E is supported on the second weight housing 60B via the second outside supporting member 276. The elastically deforming part 273F includes a second deforming part 273F1 and a weight-mounting part 273F2 (see FIG. 7). A third bolt insertion hole 273*i* is formed in the weight-mounting part 273F2. The second deforming part 273F1 is positioned between the second connecting part 273E and the weight-mounting part 273F2. Notches 273*j* are formed in the second deforming part 273F1. The notches 273*j* gradually change the width of the second deforming part 273F1. Specifically, the second deforming part 273F1 narrows toward the center region thereof. Accordingly, the cross-sectional area of the second deforming part 273F1 is smaller than the cross-sectional area in a portion where the second connecting part 273E contacts the second inside supporting member 278 and the cross-sectional section in a portion of the weight-mounting part 273F2 in which the third bolt insertion hole 273*i* is not formed.

The counterweight 274 has a roughly circular cross-section and is formed with a shaft insertion hole 274*a* formed at the center thereof. The counterweight 274 is fixed to the first and second weight-supporting members 273A and 273B by inserting the bolts 279 through the second blot insertion hole 273*g* and third bolt insertion hole 273*i*. Hence, the counterweight 274 is doubly supported on its both ends by the first and second weight-supporting members 273A and 273B. The first intermediate shaft 61 is inserted through the shaft insertion hole 274*a*. The distances from the first and second outside supporting members 275 and 276 to the positions where the counterweight 274 is fixed to the first and second weight-supporting members 273A and 273B are the same, and the distances from the first and second inside supporting members 277 and 278 to the positions where the counterweight 274 is fixed to the first and second weight-supporting members 273A and 273B are the same.

The gear housing 80 is located on the front side of the second weight housing 60B and is made from resin. A metal partition member 80A is disposed in the gear housing 80 and partitions the gear housing 80 and the weight housing 60. The gear housing 80 and the partition member 80A forms a decelerating chamber 80*a*, which is a mechanism chamber accommodating a rotation transmission mechanism described later. A second intermediate shaft 82 is rotatably supported on the gear housing 80 and the partition member 80A via a bearings 82B and 82C, and extends parallel to the output shaft 22. A side handle 16 is provided near the tool support portion 15 of the gear housing 80.

A fifth gear 81 meshingly engaged with the fourth gear 61A is coaxially fixed to the second intermediate shaft 82 on the electrical motor 21 side thereof. A gear 82A is formed on the front end portion of the second intermediate shaft 82 to be meshingly engaged with a sixth gear 83 described later. A cylinder 84 is provided above the second intermediate shaft 82 in the gear housing 80. The cylinder 84 extends parallel to the second intermediate shaft 82 and is rotatably supported on the partition member 80A. The sixth gear 83 is fixed to the outer periphery of the cylinder 84 and is meshingly engaged with the gear 82A described above so that the cylinder 84 can rotate around its central axial.

Figure 9:
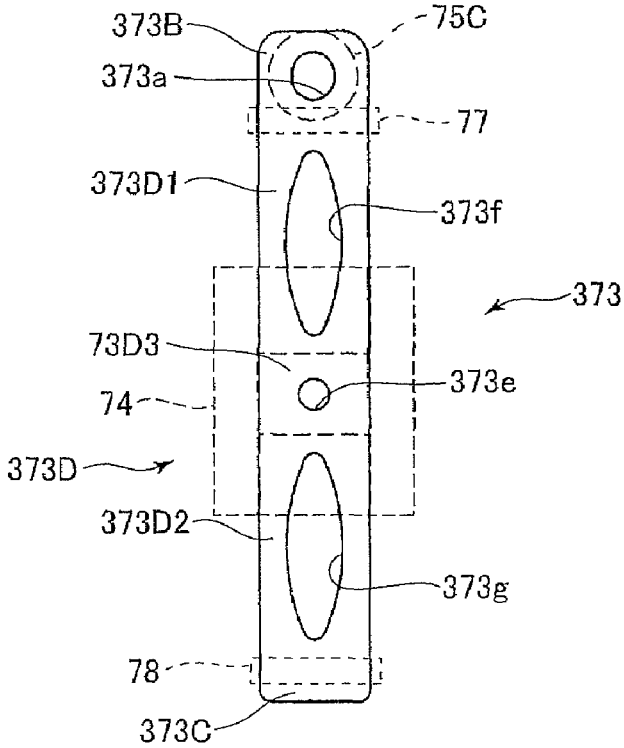
FIG. 9 is a front view showing a variation of a weight-supporting member of the impact tool according to the first embodiment of the present invention.

The tool support portion 15 is provided on the front side of the cylinder 84, and a working tool (not shown) is capable of attaching to or detaching from the tool support portion 15. A clutch 86 is splined to the intermediate section of the second intermediate shaft 82. The clutch 86 is urged by a spring toward the electrical motor 21 (the rear side). The clutch 86 can be switched by means of a change lever 87 positioned below the gear housing 80 between a hammer drill mode (the position shown in FIG. 9) and a drill mode (with the clutch 86 moved toward the front). A motion converter 90 that converts rotational motion into reciprocation motion is rotatably provided on the outer periphery of the second intermediate shaft 82 on the electrical motor 21 side of the clutch 86. The motion converter 90 has an arm 90A that is capable of reciprocating back-and-forth the impact tool 201 as a result of the rotation of the second intermediate shaft 82.

When the clutch 86 is switched to the hammer drill mode using the change lever 87, the clutch 86 engages the second intermediate shaft 82 with the motion converter 90. The motion converter 90 is connected to and work with the piston 92 provided in the cylinder 84 through a piston pin 91. The piston 92 is slidably mounted in the cylinder 84 and is capable of a reciprocation motion parallel to the second intermediate shaft 82. A striking member 93 is provided in the piston 92 and is slidably provided along the inner periphery of the cylinder 84. An air chamber 94 is formed among the cylinder 84, the piston 92, and the striking member 93. An intermediate member 95 is supported in the cylinder 84 on the opposite side of the striking member 93 from the air chamber 94. The intermediate member 95 is slidably provided against the cylinder 84 along the direction of the motion of the piston 92. A working tool (not shown) is positioned on the opposite side of the intermediate member 95 from the striking member 93. Hence, the striking member 93 strikes the working tool (not shown) through the intermediate member 95.

Rotation output of the motor 21 is transmitted to the second intermediate shaft 82 by way of the first intermediate shaft 61, the fourth gear 61A, and the fifth gear 81. The rotation of the second intermediate shaft 82 is transmitted to the cylinder 84 by way of the meshing between the gear 82A and the sixth gear 83 mounted to the outer periphery of the cylinder 84. When the clutch 86 is in the hammer drill mode by operating the change lever 87, the clutch 86 is connected to the motion converter 90. Hence, the rotational driving force of the second intermediate shaft 82 is transmitted to the motion converter 90 through the clutch 86. The rotational driving force is converted to the reciprocation motion of the piston 92 on the motion converter 90 by way of the piston pin 91. The reciprocation motion of the piston 92 causes the pressure of the air inside the air chamber 94 formed between the striking member 93 and the piston 92 to repeatedly increase and decrease, thereby causing a reciprocation motion of the striking member 93. When the striking member 93 moves forward and collides with the rear end of the intermediate member 95, the impact force is applied to the working tool (not shown) through the intermediate element 95. In this manner, the rotational force and the impact force are simultaneously applied to the working tool (not shown) in the hammer drill mode.

When the clutch 86 is in the drill mode, the clutch 86 disengages the connection between the second intermediate shaft 82 and the motion converter 90, and only the rotational driving force of the second intermediate shaft 82 is transmitted to the cylinder 84 through the gear 82A and the sixth gear 83. Accordingly, only rotational force is applied to the working tool (not shown).

When the impact tool 201 according to third embodiment is operated, a vibration having a roughly constant frequency is generated in the impact tool 201 due to the reciprocation motion of the striking member 93. The vibration is transmitted to the first and second supporting members 271 and 272 by way of the second weight housing 60B. The vibration transmitted to the first and second supporting members 271 and 272 is transmitted to the first and second weight-supporting members 273A and 273B, leading to elastic deformations of the first and second weight-supporting members 273A and 273B and the vibration of the counterweight 274 in the same directions as the directions in which the piston 92 reciprocates. Accordingly, the vibration of the impact tool 201 can be reduced by the vibration of the counterweight 274, thereby improving the operation of the impact tool 201. Further, in the weight-supporting member 273 according to the preferred embodiment, each cross-sectional area of the first and second connecting parts 273C and 273E and the weight-mounting parts 273D2 and 273F2 is not modified, but the first and second deforming parts 273D1 and 273F1 are formed narrower toward the center regions thereof. This structure can ensure the strength of the weight-supporting member 273 while preventing an increase in the length thereof and can yield a desired spring constant. The impact tool 201 according to the third embodiment also obtains the same effects as the impact tool 1 according to the first embodiment described above.

The impact tool of the present invention is not restricted to the embodiments described above, and various changes and improvements may be effected within the scope of the claims. For example, in a weight-supporting member 373 shown in FIG. 9, holes 373*f* and 373*g* may be formed in first and second deforming parts 373D1 and 373D2. By providing the holes 373*f* and 373*g* in this way, each cross-sectional area of the first and second deforming parts 373D1 and 373D2 is smaller than the cross-sectional area in a portion where a first connecting part 373B contacts the first inside supporting member 77, the cross-sectional area in a portion where a second connecting part 373C contacts the second inside supporting member 78, and the cross-sectional area in a portion of a weight-mounting part 373D3 in which a second bolt insertion hole 373*e* is not formed. In the embodiments described above, the electrical power tool of the present invention is applied to the impact tool, but it would also be possible for the present invention to be applied to a saber saw.

What is claimed is:

1. An electrical power tool comprising:

a housing;

an electrical motor accommodated in the housing;

a motion conversion mechanism configured to convert a rotary motion of the electrical motor into a reciprocation motion;

a counterweight mechanism supported at each of two opposite ends of the mechanism on the housing for reducing the vibration of the tool, the counterweight mechanism including a weight-supporting member extending in a direction perpendicular to directions of the reciprocation motion and capable of being elastically deformed in the directions of the reciprocation motion;

a counterweight supported on the weight-supporting member; and a first supporting member and a second supporting member each provided on the housing for supporting the weight-supporting member to the housing, wherein the weight-supporting member has:

a first connecting part and a second connecting part supported by the first supporting member and the second supporting member, respectively; and an elastically deforming part positioned between the first connecting part and the second connecting part and having a mounting part on which the counterweight is supported, the elastically deforming part including a portion having a smaller cross-sectional area than each cross-sectional area of the first connecting part and the second connecting part.

2. The electrical power tool according to claim 1, wherein the weight-supporting member has one end and another end, the first connecting part being located on the one end, the second connecting part being located on the another end.

3. The electrical power tool according to claim 1, wherein the first connecting part and the second connecting part are points of support for the elastic deformation of the weight-supporting member.

4. The electrical power tool according to claim 1, wherein the portion of the elastically deforming part has a gradually changing cross-sectional area.

5. The electrical power tool according to claim 4, wherein the portion of the elastically deforming part having a gradually changing cross-sectional area has a gradually changing width, the width being a dimension in a direction orthogonal to both the directions of the reciprocating motion and the direction in which the weight-supporting member extends.

6. The electrical power tool according to claim 4, wherein the portion of the elastically deforming part having a gradually changing cross-sectional area has a gradually changing thickness, the thickness being a dimension in the directions of the reciprocal motion.

7. The electrical power tool according to claim 4, wherein the portion of the elastically deforming part having a gradually changing cross-sectional area is formed with a notch.

8. The electrical power tool according to claim 4, wherein the elastically deforming part is formed with a hole.

9. The electrical power tool according to claim 1, wherein the first connecting part has a first cross-sectional area contacting the first supporting member, the second connecting part has a second cross-sectional area contacting the second supporting member, and wherein the portion of the elastically deforming part has a smaller cross-sectional area than each of the first cross-sectional area and the second cross-sectional area.

10. The electrical power tool according to claim 1, wherein the elastically deforming part has a first deforming part positioned between the mounting part and the first connecting part, and a second deforming part positioned between the mounting part and the second connecting part; and each of a portion of the first deforming part and a portion of the second deforming part has a cross-sectional area smaller than each cross-sectional area of the mounting part, the first connecting part, and the second connecting part.

11. The electrical power tool according to claim 10, wherein each of the portion of the first deforming part and the portion of the second deforming part has a gradually changing cross-sectional area.

12. The electrical power tool according to claim 11, wherein each of the portion of the first deforming part and the portion of the second deforming part having a gradually changing cross-sectional area has a gradually changing width, the width being a dimension in a direction orthogonal to both the directions of the reciprocating motion and the direction in which the weight-supporting member extends.

13. The electrical power tool according to claim 11, wherein each of the portion of the first deforming part and the portion of the second deforming part having gradually changing cross-sectional area has a gradually changing thickness, the thickness being a dimension in the directions of the reciprocal motion.

14. The electrical power tool according to claim 11, wherein each of the portion of the first deforming part and the portion of the second deforming part is formed with a notch.

15. The electrical power tool according to claim 11, wherein each of the first deforming part and the second deforming part is formed with a hole.

16. The electrical power tool according to claim 1, wherein the portion of the elastically deforming part having the smaller cross-sectional area than each cross-sectional area of the first connecting part and the second connecting part enables a desired spring constant for the elastically deforming part and resonance frequency of the counterweight mechanism while maintaining a strength of the weight-supporting member.

17. An electrical power tool comprising:

a housing;

an electrical motor accommodated in the housing;

a motion conversion mechanism configured to convert a rotary motion of the electrical motor into a reciprocation motion;

a counterweight mechanism supported on the housing for reducing the vibration of the tool, the counterweight mechanism including a weight-supporting member extending in a direction perpendicular to directions of the reciprocation motion and capable of being elastically deformed in the directions of the reciprocation motion;

a counterweight supported on the weight-supporting member; and a supporting member provided on the housing for supporting the weight-supporting member to the housing, wherein the weight-supporting member has:

a connecting part supported by the supporting member; and an elastically deforming part including a portion having a smaller cross-sectional area than cross-sectional area of the connecting part.

* * * * *